US006449988B1

(12) United States Patent
Roell

(10) Patent No.: US 6,449,988 B1
(45) Date of Patent: Sep. 17, 2002

(54) THREE-DIMENSIONAL KNITTED COVER

(75) Inventor: Friedrich Roell, Biberach (DE)

(73) Assignees: Stefan Achter, Moenchengladbach (DE); Viktor Nikolaus Achter, Cologne (DE)

( * ) Notice: Subject to any disclaimer, the term of this patent is extended or adjusted under 35 U.S.C. 154(b) by 0 days.

(21) Appl. No.: 09/857,074

(22) PCT Filed: Dec. 1, 1999

(86) PCT No.: PCT/DE99/03854

§ 371 (c)(1),
(2), (4) Date: Aug. 10, 2001

(87) PCT Pub. No.: WO00/32862

PCT Pub. Date: Jul. 8, 2000

(30) Foreign Application Priority Data

Dec. 1, 1998 (DE) ..... 198 55 543

(51) Int. Cl.[7] ..... D04B 21/00
(52) U.S. Cl. ..... 66/170; 66/64

(58) Field of Search ..... 66/171, 170, 196, 66/198, 202, 169 R, 64; 297/218.1, 218.4, 226, 225, 452.59

(56) References Cited

U.S. PATENT DOCUMENTS

| | | | | | |
|---|---|---|---|---|---|
| 5,887,452 | A | * | 3/1999 | Smith et al. | 66/170 |
| 5,890,381 | A | | 4/1999 | Leeke et al. | |
| 5,992,185 | A | * | 11/1999 | Leeke et al. | 297/218.1 |
| 6,151,926 | A | * | 11/2000 | Leeke et al. | 66/170 |

FOREIGN PATENT DOCUMENTS

| | | |
|---|---|---|
| DE | 86 29 570 | 12/1986 |
| EP | 0 361 855 | 4/1990 |
| EP | 0 734 670 | 10/1996 |

* cited by examiner

*Primary Examiner*—Danny Worrell
(74) *Attorney, Agent, or Firm*—Smith-Hill and Bedell

(57) ABSTRACT

The invention relates to a knitted seat cover, in the knit of which a bead or tubular knit is joined integrated at least in part in the region of contour lines to simultaneously mask and protect the contour lines.

14 Claims, 2 Drawing Sheets

THREE-DIMENSIONAL KNITTED COVER

TECHNICAL FIELD AND BACKGROUND OF THE INVENTION

The present invention relates to a fully fabricated three-dimensional knitted cover. Such seat covers are known e.g. from EP 0 361 855 B1. The disadvantage of these three-dimensional covers is the fact that the visual finish in the region of the contour lines, such as e.g. spiked lines, lacks true homogeneity and thus visual appeal.

SUMMARY OF THE INVENTION

It is thus the object of the invention to provide a knitted cover and a method for producing a knitted cover which masks the contour lines for visual appeal.

In accordance with the invention a tubular knit is integrated in the region of at least one contour line in a seat cover. Contour line in this context is understood to be one of the following:

a line at which the knit changes, a widening, narrowing or spike line a corner, edge or rim of a two-dimensional or three-dimensional seat cover or strongly contoured portions of a three-dimensional cover.

This tubular knit is knitted to the seat cover in knitting the latter so that it is integrally joined to the cover. This is achievable either by transferring prefabricated parts over a comb into the knitting portion of the flat bed machine or by knitting the tubular knit on separate needle beds with subsequent transfer to the needle beds on which the knitted cover is being knitted. However, it is just as possible to simply knit the bead or tubular knit into the cover whilst the remaining needles for knitting the cover remain inactive. The tubular knit conceals the contour line similar to piping to thus create a neat finish. In addition, the contour line is protected from being physically damaged.

The tubular knit must not necessarily take the form of a closed tubing, it instead being configured as a single-ply knitted tag or taking the form of a two-ply knitted tag in which e.g. one ply is knitted closer and/or with elastic thread material and/or thermalized so that this ply is closer than the other ply, resulting in the tag rolling up into an open tubing. However, the tubular knit may also be knitted as a closed tubing. The way in which the tubular knit is configured is irrelevant for its function in masking and protecting the contour lines from damage.

To produce a variety of visual effects the tubing can, of course, be knitted with patterns, markings, defined perforations, reinforcements, optical fibers, differing binding variants, in thermoplastic or elastic materials, e.g. with a rubber thread having an elasticity exceeding 50%, as a result of which this piping may also be employed as a bumper rim.

Lengthwise the tubing may be knitted ditferingly in thickness, or it may be spiked to produce a jagged edge in thus creating a wealth of differing patterns, all of which, however, serve in the same way to mask the contour lines or to protect them from damage in forming a bumper edge.

BRIEF DESCRIPTION OF THE DRAWINGS

Eight different embodiments of tubular knit will now be detailled by way of example as shown in the drawings in which.

DETAILLED DESCRIPTION

It is to be noted that the tubular knits as shown in FIGS. 1 to 8 can be provided in the region of knit contour lines, such as e.g. spiked lines, widening/narrowing lines and/or in the region of contour lines of a three-dimensional seat cover, e.g. at edges or corner portions.

Figure 1:
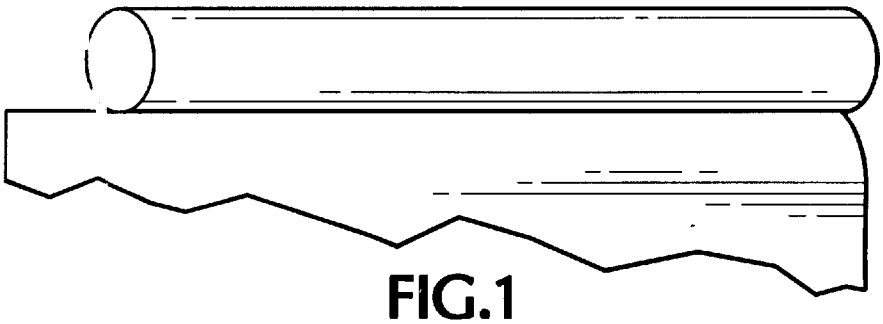
FIG. 1 is an illustration of a closed tubular knit.

Referring now to FIG. 1 there is illustrated a conventional closed tubular knit suitable for filling e.g. with a monofilament optionally either during production or subsequent thereto. This is particularly of advantage when the tubing is transferred as a prefabricated item, e.g. off-the-roll into the knitting portion of the flat bed machine for knitting into the knitted cover; although, of course, the tubing may also remain unfilled.

Figure 2:
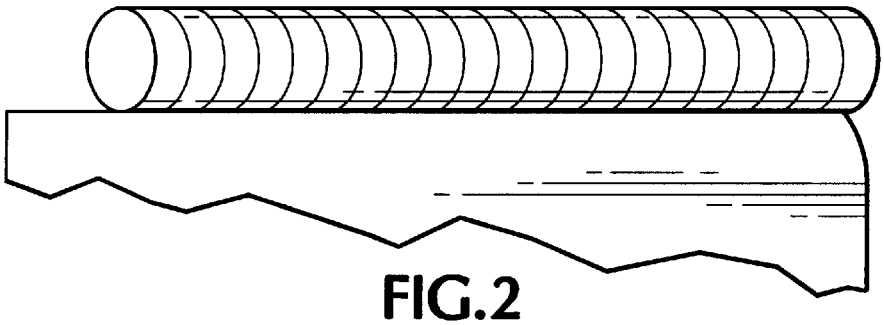
FIG. 2 is an illustration of a radially patterned closed tubular knit.
Figure 3:
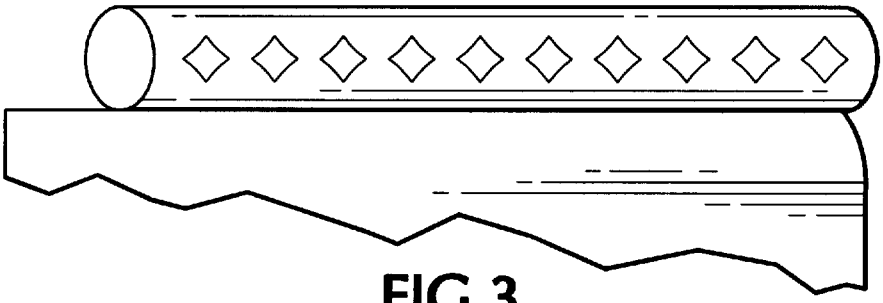
FIG. 3 is an illustration of a regularly perforated closed tubular knit.

Referring now to FIGS. 2 and 3 there is illustrated a simple means of patterning a tubing, whereby the stripes as shown in FIG. 2 may be produced by a Jacquard knit or by inserted warp or weft threads.

The perforations as shown in FIG. 3 may be produced by simply repeating narrowing and widening or by spiking, a pleasing two-color finish being possible in this respect by inserting a monofilament colored other than that of the tubing. Thus, for example, the tubing may be knitted black whilst the monofilament is red for exposure through the perforations in the tubing. The monofilament could also be an optical fiber to thus achieve a highly attractive visual effect by the light from the optical fiber shining through the perforations.

Figure 4:
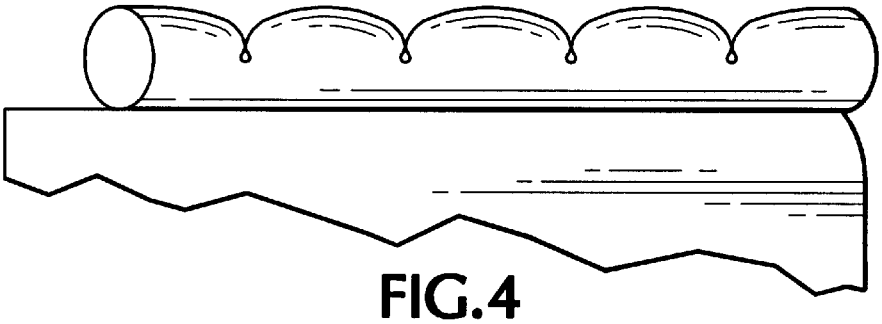
FIG. 4 is an illustration of a rubber edged closed tubular knit.

Referring now to FIG. 4 there is illustrated how the tubular knit is produced by knitting the tubing in its exposed portion, for example, with a rubber thread and tacking, e.g. by interknitting the wall of the tubing to the knitted cover at regularly intervals to thus create a wavy tubing as shown which can also be put to use to good effect as a bumper edge preferably in edge and corner portions of the cover. Preferably the first courses are knitted with an elastic thread and retained on the needles punctiform whilst the remaining portion of the tubing is knitted with the normal thread.

Figure 5:
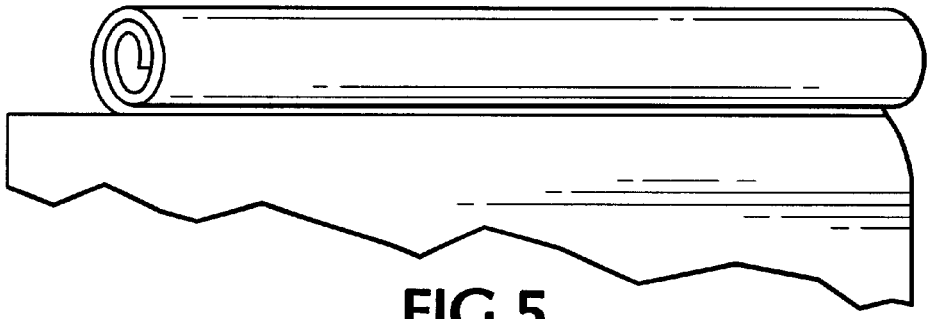
FIG. 5 is an illustration of a open tubular knit in the form of a rolled up tag.

Referring now to FIG. 5 there is illustrated yet another embodiment of a tubular knit. In this case, the tubular knit is formed by a rolled-up tag which thus, just like the closed tubes as shown in FIGS. 1 to 4, forms a tubular bead. This bead-like configuration too, is termed a tubular knit in the sense of the present invention. This bead is created, for example, by the tag being knitted two-ply, whereby one ply is knitted closer and/or with an elastic thread, resulting in it being more contracted than the other ply and thus causing the tag to roll up bead-like as shown in FIG. 5.

Figure 8:
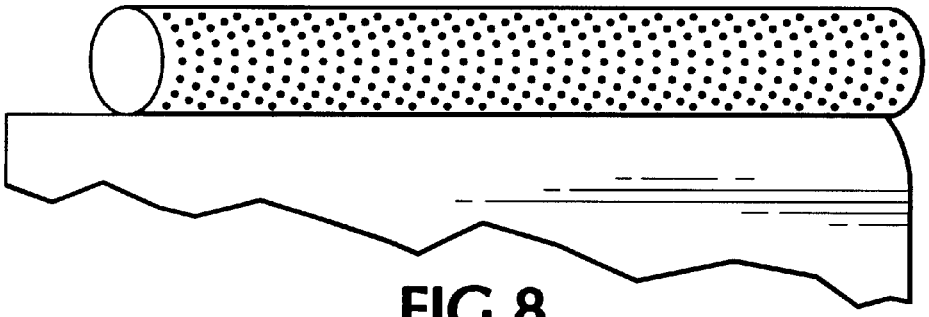
FIG. 8 is an illustration of a spotted closed tubular knit.

It will readily be understood that a tubing can also be produced spotted, of course, as shown in FIG. 8 by knitting for example the two plies of the tubing in different colors and transferring the loops in the region of the decorative spots, for example, by a Jacquard knit and accentuated, where necessary, by tucking.

Figure 6:
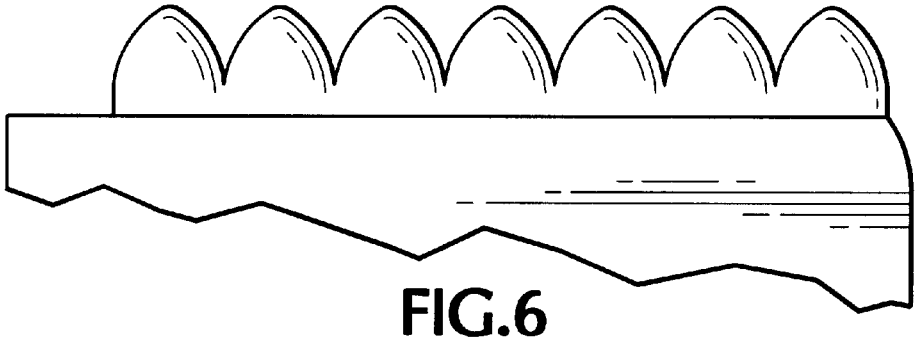
FIG. 6 is an illustration of a jagged edge produced by spiking.
Figure 7:
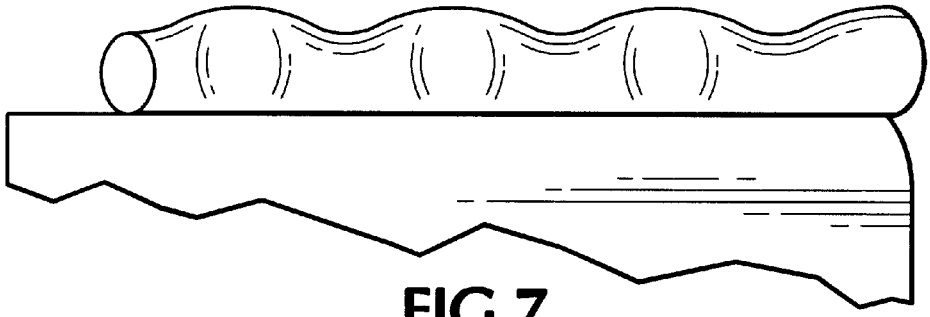
FIG. 7 is an illustration of a wavy closed tubular knit.

Referring now to FIGS. 6 and 7 there are illustrated two further aspects in configuring a tubular knit or knitted bead whose geometry is varied axially. In FIG. 7 the thickness of the tubing is varied to achieve a wavy appearance of the tubing. This is quite simply produced technically by knitting the loops differingly close and/or with differingly thick thread materials in the region of the tubing. For this purpose, use may also be made of axially alternating differing links.

In FIG. 6 a jagged configuration of the tubing is achieved by large perforations being created in the tubing by spiking, here too, this achieving a highly attractive pattern which may be further enhanced by filling the tubing with a monofilament in a different color.

It is of just as possible to work the tubing into the cover directly in part simply by rendering the needles knitting the cover inactive. The tubing may also be knitted single-ply or multi-ply including openings, reinforcements or patterns.

When the tubing is knitted on the inside pile looped, e.g. with a frotté structure, the piping formed by the tubular knit is automatically filled. When the pile looped side faces outwards, this may be made use of for decorative purposes. The tubing may also be filled by working with a pile link.

To stabilize the tubing, especially its ends may be knitted with a fusible thread.

What is claimed is:

1. A seat cover comprising:

a knitted fabric seat element having an exterior surface and a contour line, and an elongate protective element extending along said contour line at the exterior surface of the knitted fabric seat element and joined to the knitted fabric seat element, said elongate protective element being a knit element that is integrated with the knit of the fabric seat element.

2. A seat cover according to claim 1, wherein the elongate protective element is a tubular knit element.

3. A seat cover according to claim 2, wherein the tubular knit element is a two-ply knit element having loops knitted more densely in one ply than in the other ply.

4. A seat cover according to claim 3, wherein said one ply is composed of an elastic thread material of elasticity exceeding 50%.

5. A seat cover according to claim 2, wherein the tubular knit element defines an interior passage and the seat cover includes a strand extending within said interior passage.

6. A seat cover according to claim 5, wherein the strand is a monofilament.

7. A seat cover according to claim 5, wherein the strand is a wire.

8. A seat cover according to claim 2, wherein the tubular knit element has a peripheral wall and said peripheral wall is formed with perforations.

9. A seat cover according to claim 1, wherein the contour line is a spike line.

10. A seat cover according to claim 1, wherein the protective element is a rolled-up tag.

11. A method of making a seat cover that comprises a knitted fabric seat element having an exterior surface and a contour line, and an elongate protective element extending along said contour line at the exterior surface of the knitted fabric seat element and joined to the knitted fabric seat element, said elongate protective element being a knit element that is integrated with the knit of the fabric seat element, said method comprising knitting the seat element on first needle beds, knitting the elongate protective element on second needle beds, and transferring the elongate protective element from the second needle beds to the first needle beds.

12. A method according to claim 11, wherein the elongate protective element is a tag having a proximal region and a distal region, the proximal region of the protective element being between the seat element and the distal region of the protective element, and the method comprises knitting the proximal region of the protective element more densely than the distal region thereof.

13. A method according to claim 11, wherein the elongate protective element is a two-ply tag attached to the seat element, and the method comprises knitting one ply of the protective element more densely than the other ply thereof.

14. A method of making a seat cover that comprises a knitted fabric seat element having an exterior surface and a contour line, and an elongate protective element extending along said contour line at the exterior surface of the knitted fabric seat element and joined to the knitted fabric seat element, said elongate protective element being an elongate tubular knit element that is integrated with the knit of the fabric seat element, said method comprising supplying the tubular knit element off-the-roll and cutting the tubular knit element to length during knitting.

* * * * *